US005809601A

United States Patent [19]

Rivera

[11] Patent Number: 5,809,601

[45] Date of Patent: Sep. 22, 1998

[54] DEVICE FOR CLEANING THE INTERIOR OF A TUBULAR MEMBER

[75] Inventor: Valentin Rivera, Chicago, Ill.

[73] Assignee: JR Associates, Inc., Chicago, Ill.

[21] Appl. No.: 710,497

[22] Filed: Sep. 18, 1996

Related U.S. Application Data

[63] Continuation of Ser. No. 518,677, Aug. 24, 1995, abandoned.

[51] Int. Cl.[6] ..... A46B 13/02

[52] U.S. Cl. ..... 15/23; 15/88; 15/104.05; 15/104.095

[58] Field of Search ..... 15/23, 4, 22.1, 15/88, 104.04, 104.05, 104.095

[56] References Cited

U.S. PATENT DOCUMENTS

| | | | |
|---|---|---|---|
| 1,583,001 | 5/1926 | Meints | 15/23 |
| 1,872,198 | 8/1932 | Van Rixel, Jr. . | |
| 2,824,322 | 2/1958 | Angelica et al. . | |
| 3,293,680 | 12/1966 | Wilson et al. | 15/23 |
| 3,343,192 | 9/1967 | Goldstein et al. . | |
| 3,430,279 | 3/1969 | Hintze | 15/23 |
| 3,604,040 | 9/1971 | Cohen | 15/23 |
| 4,238,867 | 12/1980 | Ruggero et al. | 15/23 |
| 4,397,055 | 8/1983 | Cuchiara . | |
| 4,726,137 | 2/1988 | Zurek et al. . | |
| 4,796,323 | 1/1989 | Benz . | |
| 4,850,071 | 7/1989 | Lawrence | 15/23 |
| 4,930,240 | 6/1990 | Bice . | |
| 5,115,534 | 5/1992 | Fournier | 15/23 |
| 5,235,716 | 8/1993 | Stella | 15/23 |
| 5,307,534 | 5/1994 | Miller | 15/104.05 |
| 5,426,807 | 6/1995 | Grimsley et al. | 15/104.095 |
| 5,450,646 | 9/1995 | McHugh et al. | 15/23 |

*Primary Examiner*—Denise L. Ferensic
*Assistant Examiner*—James F. Hook
*Attorney, Agent, or Firm*—Hill & Simpson

[57] ABSTRACT

A cleaning device is provided for cleaning a barrel of a gun. To this end, a portable, hand-held motor encased within a housing is connected to a shaft. The motor may be either AC or DC powered. The shaft is connectable to a coupling member and preferably secured to the shaft by a set screw. A second shaft is connected at an opposite end of the coupler. The second coupler is threaded to receive a threaded end of a brush. The brush, therefore, may be removably secured to the threaded end of the second shaft. When the brush is inserted into the barrel of the gun and power is provided to the motor, the shafts rotate allowing the brush to clean the barrel.

19 Claims, 1 Drawing Sheet

DEVICE FOR CLEANING THE INTERIOR OF A TUBULAR MEMBER

This is a continuation of application Ser. No. 08/518,677, filed Aug. 24,1995, now abandoned.

BACKGROUND OF THE INVENTION

The present invention generally relates to a device for cleaning. More specifically, the present invention relates to a portable, motorized device used for cleaning a tubular member, such as a barrel of a gun.

It is, of course, generally known to clean the barrel of a gun following usage of the gun. Traditionally, cleaning brushes were used that required movement in an interior of the barrel by means of a rod fastened to a brush carrier. To simplify the cleaning process, motorized devices have been contemplated. One such motorized device is shown and described in U.S. Pat. No. 4,930,240 to Bice.

Bice discloses a gun barrel cleaning device including an elongated shaft having a driving head at one end dimensioned for engagement with a battery-powered reversible electric screwdriver. One of a variety of available cleaning implements is secured to the shaft through a pair of cooperating threaded fasteners. An elongated shaft may be employed depending upon the length of a gun barrel to be cleaned. The fasteners form a rotary driving connection which enables the cleaning implement to be rotated in either a forward or reverse direction within the gun barrel. The cleaning implement may take the form of a rotary brush having a spiral bristle array with a pitch corresponding to the rifling groove pitch of a barrel to be cleaned, a slotted holder for a fabric cleaning patch or a conical threaded bullet extractor.

Such known barrel cleaning devices, however, are complex in terms of the variety of adaptations and possible arrangements therefore. Further, the devices are complex in that brushes are not simply replaceable with various sized brushes depending on the size of the barrel to be cleaned.

A need, therefore, exists for a simplified cleaning device, particularly for cleaning the barrel of a gun that is simple to use, simple to replace brushes therefrom and capable of securing brushes of various sizes without replacing or adding on to its shaft.

SUMMARY OF THE INVENTION

A cleaning device is provided, particularly for cleaning the interior of a barrel of a gun. A brush is removably secured to an end of a shaft that is rotatable by a portable, hand-held motor-driven device.

To this end, in an embodiment, a cleaning device is provided having a housing with a motor in the housing. A first shaft extends from an end of the housing wherein the shaft is driven by the motor. A coupler has a first end connected to the shaft and further has a second end. A second shaft is connected to the second end of the coupler at the first end and has a second end. A brush is removably connected to the second end of the second shaft.

In an embodiment, the second end of the second shaft is threaded.

In an embodiment, the brush includes a shaft having a threaded end removably connectable to the second shaft.

In an embodiment, the second shaft has a length substantially longer than the first shaft.

In an embodiment, the first shaft and the second shaft have substantially equal diameters.

In an embodiment, a power source is connected to the motor. The power source may be a battery or DC power.

In an embodiment, the second end of the second shaft is threaded so as to be capable of independently receiving at least two different sized brushes.

In an embodiment, a set screw is received in an aperture of the coupler to secure the coupler to the first shaft.

In an embodiment, the brush has a diameter greater than a diameter of the second shaft.

In another embodiment of the present invention, an apparatus is provided for cleaning a barrel of a gun. The apparatus has a housing having a motor in the housing. A shaft is connected to the motor in the housing capable of rotating the shaft wherein the shaft has a variably sized threaded aperture at an end remote from the housing. A brush is removably connectable to the variably sized threaded aperture wherein the brush has a diameter greater than a diameter of the shaft.

In an embodiment, a coupler is constructed and arranged between the housing and the shaft wherein the shaft is removably connected to the coupler.

It is, therefore, ad advantage of the present invention to provide a device for cleaning the barrel of a gun.

Another advantage of the present invention is to provide a device that simply cleans the barrel of a gun.

Yet another advantage of the present invention is to provide a device that cleans the barrel of a gun having a replaceable brush.

A still further advantage of the present invention is to provide a device for cleaning the barrel of a shaft that is portable.

And, another advantage of the present invention is to provide a device for cleaning the barrel of a gun requiring a minimum number of parts.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a cleaning device, particularly for use in cleaning a barrel of a gun. Of course, other uses may be implemented by those skilled in the art, such as cleaning of, for example, other tubular members.

Figure 1:
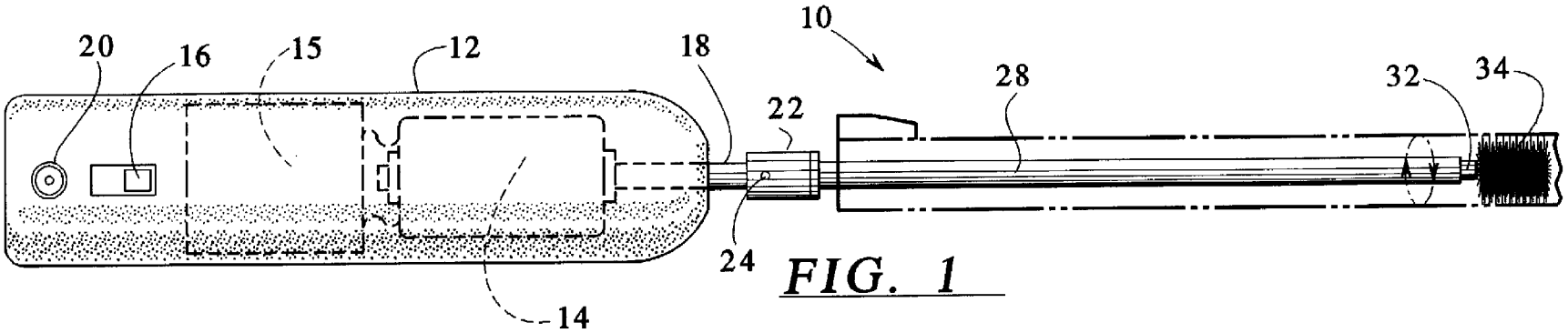
FIG. 1 illustrates a perspective view of an embodiment of a gun barrel cleaning device of the present invention.
Figure 2:
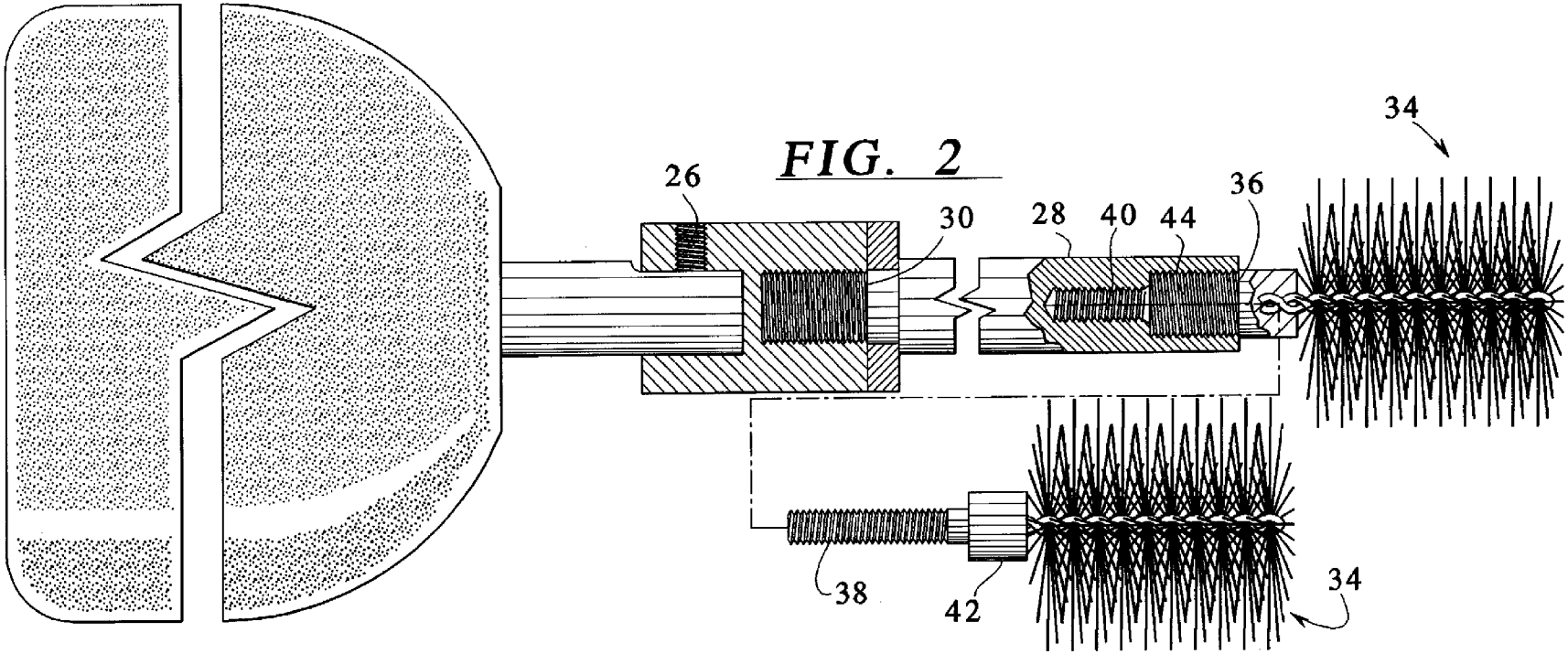
FIG. 2 illustrates a perspective view, partially in cross-sectional detail, of an embodiment of a gun barrel cleaning device of the present invention.

Referring now to FIGS. 1 and 2 wherein like numerals refer to like parts, FIG. 1 illustrates an embodiment of a gun cleaning device 10. As shown, the gun cleaning device 10 has a housing 12 having contained therein a motor 14. The motor 14 may be powered by a DC source 15, such as a battery, or an AC source, such as by connecting the device 10 to an outlet providing a source of electricity.

As illustrated, the housing 12 includes a switch 16. The switch 16 activates the motor driving a shaft 18 causing the shaft 18 to rotate. A charging socket 20 may be provided for recharging the source of DC power 15, such as a battery contained within the housing 12. The motor 14 is a one-way or single direction motor. The unidirectional requirement of the motor 14 will be understood and appreciated when referencing the connections between the shafts, the coupling member and the brush to be described hereinafter.

As previously set forth, the shaft 18 is connected to the motor 14 in the housing 12. A coupling member 22 connects to the shaft 18. To this end, a set screw 24 secures the coupling member 22 to the shaft 18. The coupling member 22 includes a threaded aperture 26 for receipt of the set screw 24 therein.

Attached to the coupling member 22 at its opposite end is a second shaft 28. The shaft 28 includes an end threaded for reception into a threaded aperture 30 of the coupling member 22. The shaft 28 rotates in the direction shown by the arrows in FIG. 1 following activation of the switch 16 providing power to the motor 14. At the end of the shaft 28 is connected a removable shaft 32 having a brush 34 attached thereto. The brush 34 includes bristles, preferably made from nylon which, when rotated within the barrel of a gun, for example, cleans the barrel of the gun.

As illustrated in FIG. 2, a threaded aperture 36 at an end of the shaft 28 receiving the brush 34 is capable of independently receiving two differently sized shafts therein. To this end, the brush 34 may include a threaded end 38 that is receivably connected in a lower end 40 of the threaded aperture 36. When this type of brush is used, a wider portion 42 of the brush 34 extends into a portion of an upper end 44 of the threaded aperture 36 so as to prevent any side-to-side movement and allow only rotary movement when in use. Alternatively, the brush 34 may include only a larger diameter threaded end for receipt only in the upper end 44 of the threaded aperture 36.

The threading of the aperture 36 and the threaded end 38 of the brush 34 is such that upon rotation of the brush 34 in the single direction provided for the unidirectional motor, the brush 34 may not be loosened or separated from the shaft 28. Likewise, the shaft 28 is secured to the coupling member 22 and threaded in a similar manner to prevent removal between the two members.

In use, a brush of a size corresponding to the size of the tubular member, such as a gun barrel, is selected. The brush 34 is attached to an end of the shaft 28. The shaft 28 preferably is attached to the coupling member 22 previously, but may require separate attachment thereto. After the device 10 is assembled, the brush 34 is inserted into the tubular member and power to the motor 14 is initiated by activating the switch 16 to an "ON" position. Following activation, the shaft 28 and hence the brush 34 rotate causing bristles of the brush to contact interior walls of the tubular member. As a result, the tubular member is cleaned from debris and the like that has collected on the walls. To this end, the brush 34 is moved along the length of the tubular member by a user gripping the housing 12 and transposing the housing in a forward and backward direction while maintaining the brush 34 substantially within the interior of the tubular member.

After the cleaning operation is completed, power to the motor 14 is stopped, and the brush may be removed from the interior of the tubular member. After repeated uses, the brush 34 may require disposal and replacement thereof. Further, differently sized brushes may be required from use-to-use. The present invention provides for simple and quick replacement and/or switching of brushes due to its unique design.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A cleaning device comprising;

a housing having an interior;

a motor in the interior of the housing;

a first shaft extending from an end of the housing exterior to the interior of the housing wherein the first shaft is driven by the motor;

a coupler having a first end connected to the first shaft and further having a second end;

a second shaft exterior to the housing connected to the second end of the coupler at its first end and having a second end including an opening a first section having a first diameter and a second section having a second diameter different than the first diameter wherein the second shaft is continuously and integrally formed and is substantially longer than the first shaft and further wherein the first shaft and the second shaft are straight with uniform cross-section wherein the first shaft and the second shaft have equal diameters and the coupler has a diameter greater than the first shaft and the second shaft; and a brush removably connected to the opening at the second end of the second shaft.

2. The cleaning device of claim 1 wherein the second end of the second shaft is threaded.

3. The cleaning device of claim 1 wherein the brush includes a shaft having a threaded end removably connectable to the second shaft.

4. The cleaning device of claim 1 wherein the second shaft has a length substantially longer than the first shaft.

5. The cleaning device of claim 1 wherein the first shaft and the second shaft have substantially equal diameters.

6. The cleaning device of claim 1 further comprising:

a power source connected to the motor.

7. The cleaning device of claim 6 wherein the power source is a battery.

8. The cleaning device of claim 1 wherein the second end of the second shaft is threaded so as to be capable of receiving at least two different sized brushes.

9. The cleaning device of claim 1 further comprising:

a set screw received in an aperture of the coupler to secure the coupler to the first shaft.

10. The cleaning device of claim 1 wherein the brush has a diameter greater than a diameter of the second shaft.

11. The apparatus of claim 1 wherein the brush includes bristles radially arranged.

12. An apparatus for cleaning a barrel of a gun, the apparatus comprising:

a housing having a motor in an interior of the housing;

a shaft connected to the motor in the housing capable of rotating the shaft wherein the shaft has an opening including a first section having a first diameter and a second section having a second diameter different than the first diameter at an end remote from the housing and further wherein the shaft has a length wherein a majority of the length is exterior to the interior of the housing and further wherein the shaft is continuously, integrally formed and is straight with a uniform cross-section; and a brush having a threaded end removably connectable to the opening wherein the brush has a diameter greater than a diameter of the shaft.

13. The apparatus of claim 12 further comprising:

a coupler constructed and arranged between the housing and the shaft wherein the shaft is removably connected to the coupler.

14. The apparatus of claim 13 further comprising:

a set screw capable of securing the coupler to the housing.

15. The apparatus of claim 12 wherein the motor is DC-powered.

16. The apparatus of claim 12 wherein the shaft has a length substantially greater than a length of the brush.

17. A method for cleaning the barrel of a gun, the method comprising the steps of:

providing a housing having an interior;

providing a motor in the interior of the housing;

connecting a continuous and integrally formed shaft to the motor in the housing wherein the shaft has a length such that a majority of the length is exterior to the interior of the housing and further wherein the shaft is straight with a uniform cross-section;

removably connecting a brush to an end of the shaft wherein having a first diameter and a second section having a second capable of receiving brushes of various diameters; and rotating the shaft by activating the motor such that the brush cleans the barrel of the gun.

18. The method of claim 17 further comprising the step of:

providing a variably sized threaded aperture at the end of the shaft connecting the brush to the shaft.

19. The method of claim 17 further comprising the step of:

removably connecting the shaft to a coupler extending from the housing.

* * * * *